United States Patent [19]

Garlaschi

[11] 4,366,588

[45] Jan. 4, 1983

[54] DOUBLE BLOW METHOD AND PRESS FOR PRODUCING TUBULAR RIVETS

[76] Inventor: Eufemia Garlaschi, Via Victor Hugo, 4-Milan, Italy

[21] Appl. No.: 151,931

[22] Filed: May 21, 1980

[30] Foreign Application Priority Data

Jun. 7, 1979 [IT] Italy ..... 23355 A/79

[51] Int. Cl.[3] ..... B21K 1/60

[52] U.S. Cl. ..... 10/11 A; 10/27 R; 10/27 E

[58] Field of Search ..... 10/11 R, 11 A, 11 E, 10/11 R, 12.5, 15, 17, 24, 26, 27 R, 27 E, 27 PH; 72/354, 372

[56] References Cited

U.S. PATENT DOCUMENTS 2,586,336 2/1952 Huck ..... 10/27 PH 3,720,968 3/1973 Garlasch ..... 10/11 A 4,136,417 1/1979 Dahmen et al. ..... 10/27 PH

*Primary Examiner*—Mark Rosenbaum

*Attorney, Agent, or Firm*—Stevens, Davis, Miller & Mosher

[57] ABSTRACT

A double blow method and press for producing tubular rivets is involved with a fixed die, a preparation and a finishing punch and a bore-forming pin. During the first blow the pin is positioned in the die bore in a first position, the preparation punch inserts a pre-cut wire-piece partially in the die bore and forms a crude head on the wire-piece, than the pin is moved to a second position to produce a partial bore in the wire-piece. During the second blow the finishing punch produces the final deformation of the rivet head and the pin moves in a third more advanced position to extend the bore in the rivet shank until it passes beyond its head.

10 Claims, 7 Drawing Figures

DOUBLE BLOW METHOD AND PRESS FOR PRODUCING TUBULAR RIVETS

Figure 1:
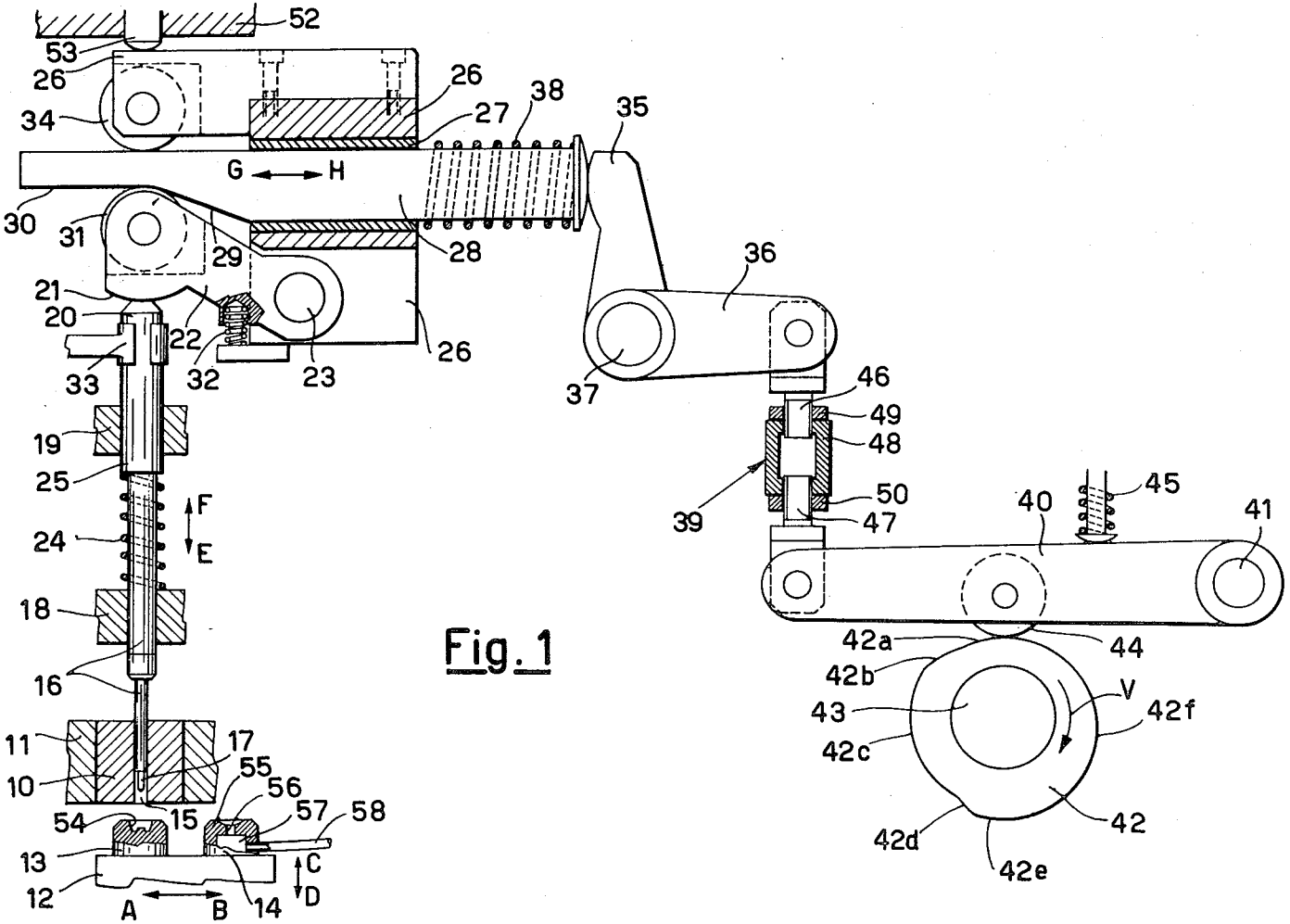
Figure 2:
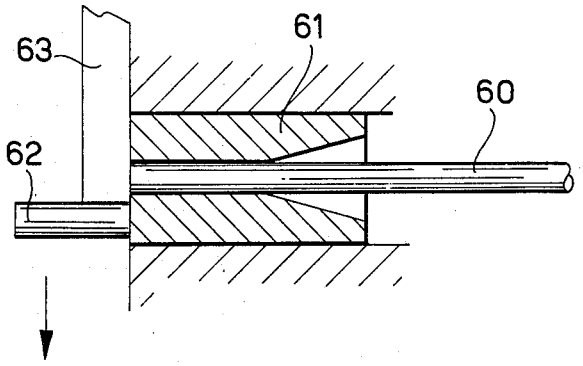
Figure 3:
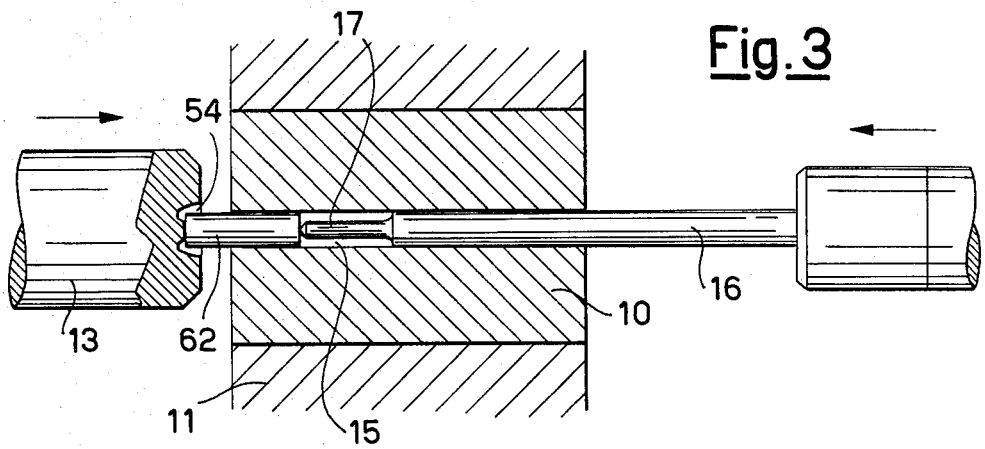
Figure 4:
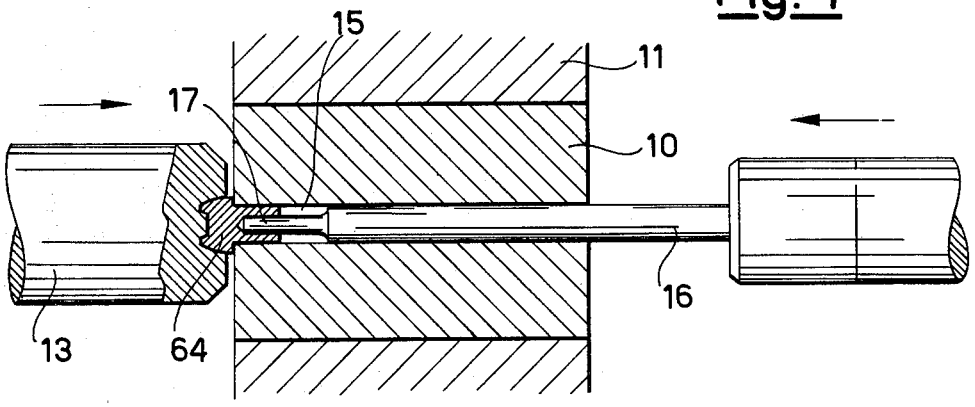
Figure 5:
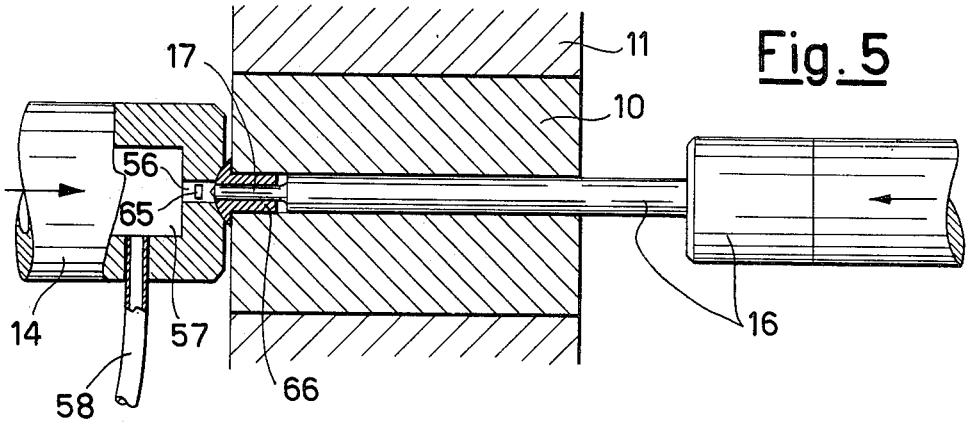
Figure 6:
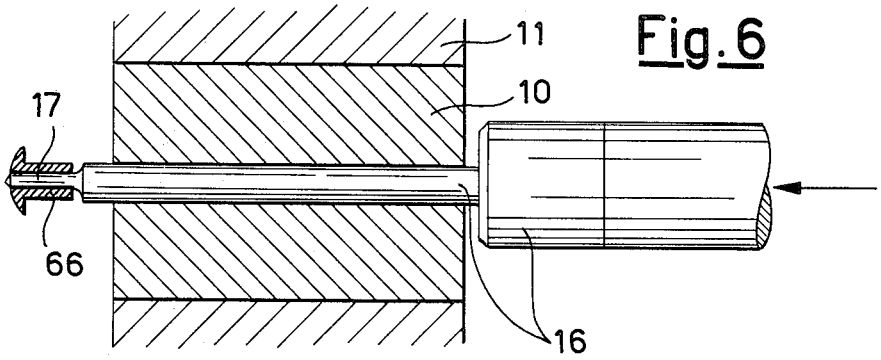
Figure 7:
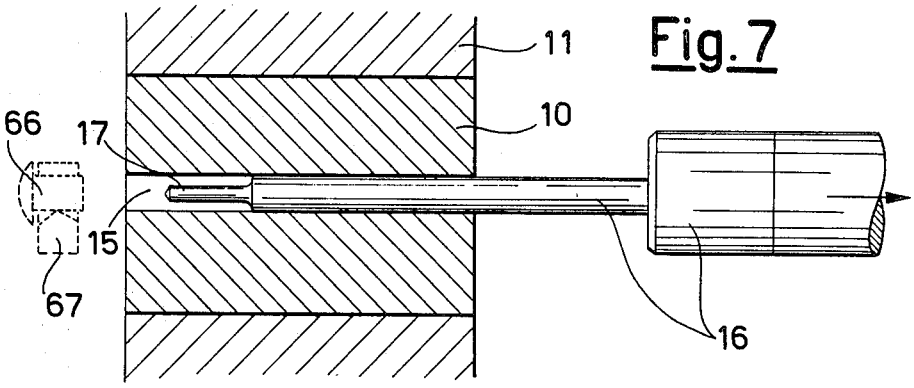

This invention relates to a double blow method and press for producing tubular rivets.

In certain applications, tubular rivets are required, in which in contrast to semi-tubular rivets the axial bore extends beyond the shank and through the rivet head, to form a through bore.

A double blow press for producing tubular rivets is known for example from U.S. Pat. No. 3,471,879.

This known press comprises substantially an axially bored die mounted in a die holder, two punches, namely a preparation punch and a finishing punch, carried by a punch holder and arranged for alternate alignment with the die bore for carrying out the first and second blow respectively, a pin of which one end penetrates coaxially into the die bore from the side opposite the side on which the punches act, and means acting on the other end of the pin on the outside of the die in order to cause it to make axial movements, said means comprising a double stepped cam and means for shifting said cam in such a manner as to make one or other of its steps active.

In this known press, the die is mounted slidable in the die holder between an advanced rest position and a withdrawn position, against the action of resilient means.

The method of operation of the press for producing a tubular rivet is as follows.

During the first blow, by means of a mobile rod carried by it, the preparation punch inserts a piece of wire into the die bore until the wire comes into contact with the pin end. During this stage, the pin is in a fixed position determined by a first step on said cam. As the preparation punch continues its advancement stroke, it initiates extrusion of the wire metal about the end of the fixed pin and the deformation of the external end of the wire, so that the punch comes into contact with the die and moves it into its withdrawn position. During this movement, both the extrusion of the wire metal about the pin end and the formation of the solid rivet head in a front cavity in the punch are completed. At this point, the first blow finishes with the die withdrawn, and in which a rivet is formed with a shank bored as far as its solid head, the shank being mounted over the end of the pin and the head being enclosed in the front cavity of the punch. The preparation punch is then withdrawn, and the die returns to its advanced rest position together with the semi-tubular rivet contained in it.

The finished punch is now aligned with the die bore, and the second blow begins. The finishing punch comes into contact with the die to receive the rivet head in its front cavity, and again moves the die into its withdrawn position, after which the cam acting on the outer end of the pin is shifted in order to make its second step, which is higher than the first, active and thus cause a corresponding movement of the pin towards the finishing punch. The movement stroke of the pin is such that it shears the bridge which remained in the rivet heat after the first blow, and this bridge is expelled through a bore in the finishing punch, so that a tubular rivet is obtained in which the bore extends beyond the shank and axially traverses the head. The second blow of the press finishes here.

One drawback of this known press is the fact that it uses a mobile die, which is moved twice during each complete working cycle from its rest position to its withdrawn position and vice versa, and is therefore subject to considerable wear, and giving rise to fatiguing of the resilient means which have to return it to its rest position.

The production of tubular rivets has also been preposed on a fixed die press (see for example U.S. Pat. No. 2,586,336), but in this case three punches are used, and the press operates with three blows for each working cycle.

The object of the present invention is to provide a press for producing tubular rivets which is fitted with a fixed die, i.e. which does not slide in a die holder, and only two punches, namely a preparation and a finishing punch. In other words, the invention obviates the drawbacks from a mobile die, together with punches fitted with mobile rods or the use of more than two punches, thus constructionally simplifying the press and making its operation more reliable and rapid.

These and further objects are attained according to the invention by producing tubular rivets on a double blow press of the type initially indicated, by means of the following operations:

(a) in a first working stage (first blow):

inserting a pre-cut piece of wire partly into the fixed die bore, by means of the preparation punch, until the wire comes into contact with a bore-forming pin positioned in the die bore in a first position, deforming that part of the wire which has not penetrated into the die bore in order to form a crude head by means of a frontal cavity in the preparation punch, moving said pin from said first position to a second more advanced position in the die bore in order to extrude the wire material about the end of the pin inside the die in order to produce a partial bore in the wire material to the required depth;

(b) in a second working stage (second blow):

carrying out final deformation of the rivet head by means of the finishing punch, simultaneously moving said pin from said second to a third more advanced position in order to further extend the bore in the rivet shank until it passes beyond its head, to shear a material bridge piece and finally expel it into a cavity in the finishing punch.

The aforesaid method is carried out according to the invention by comprising, in a double blow cold press provided with an axially bored die mounted in a fixed position in a die holder, a preparation punch and a finishing punch which can be aligned alternately with the die bore, and a bore-forming pin disposed with one of its ends in the die bore and movable in said bore in a direction towards the punches by means acting on its other end outside the die on the opposite side to the punches, (a) means for moving said pin from a first position to a second more advanced position in the die bore while the preparation punch is aligned with the die bore and is being moved towards the die until a residual distance remains, after having previously inserted a wire piece into the die bore and formed a crude head on that part of the wire projecting from the die, (b) means for moving said pin from said second position to a third more advanced position in which that end thereof facing the punches emerges from the die while the finishing punch is aligned with the die bore and, in contact with the previously formed crude head, is moving towards the die in order to carry out final deformation of the head, and to extend the bore in the wire until it axially traverses the rivet head.

According to a preferred embodiment, said means for moving the bore-forming pin from the first to the second and finally to the third advanced position are constituted by a wedge with its inclined surface facing that end of the pin on the outside of the die on the opposite side to the side comprising the punches, said wedge being movable perpendicular to the pin axis.

Said wedge can be suitably moved by a three stepped cam mounted on a press shaft which is synchronised with the control means for the punch movements.

The wedge can also be provided with a front flat projection parallel to the direction of its movement, which in combination with means for adjusting the position of the wedge relative to the pin allows tubular rivets of different length to be produced, the advancement strokes of the wedge remaining unchanged.

The invention is described in detail hereinafter with reference to the accompanying drawings, in which:

FIG. 1 is a partly sectional diagrammatic view showing the die, punches and bore-forming pin with the relative control means, and FIGS. 2 to 7 show successive operational stages of the press for producing a tubular rivet.

It will be noted that only those parts of the double blow cold press are illustrated on the drawings which are necessary for understanding the invention, whereas all other parts and the overall structure of the press can be constructed in a manner known to the art, for example as illustrated in U.S. Pat. No. 3,720,968.

The press according to the invention comprises an axially bored die 10 mounted in a fixed manner in a die holder 11.

In front of the holder 11 there is a punch holder 12 which carries a preparation punch 13 and a finishing punch 14. The holder 12 can be moved in the direction indicated by the arrows A and B in order to bring one or other of the two punches 13, 14 alternately in axial alignment with the die 10, and can also be moved in the direction of the arrows C and D in the sense of approaching or withdrawing from the die when one of the two punches is aligned therewith. These movements and the means which cause them are well known and can be constructed as described and illustrated in U.S. Pat. No. 3,720,968.

A pin 16 with a profiled head 17 is inserted into the through bore 15 in the die 10 at the opposite end to the punch holder 12, the part of said pin which is external to the die 10 being guided in two guide bearings 18, 19 forming part of the press frame.

That end 20 of the pin 16 which lies outside the die 10 and distant from the profiled head 17 rests against a spherical surface 21 at the end of a lever 22 which reciprocates about a pin 23, contact between the end 20 of the pin and the spherical surface 21 being ensured by a spring 24 acting between a shoulder 25 on the pin and the fixed guide 18.

The pin 23 about which the lever 22 reciprocates is carried by an adjustable support 26, in which there is mounted a guide bearing 27 for a wedge element 28 having an inclined surface 29 and a flat front part 30 which face the lever 22, which is in contact with said inclined surface 29 or said flat part 30 by way of a roller 31 supported freely rotatably at the end of the lever 22 distant from the spherical surface 21. A spring 32 acting on the lever 22 keeps the roller 31 in contact with the inclined surface 29 of flat part 30.

It should be noted that the direction of movement of the pin 16, indicated by the arrows E–F, is perpendicular to the direction of the wedge element 28, indicated by the arrows G–H.

A member 33 can also act at the end 20 of the pin 16 for moving the pin 16 in the direction of the arrow E, independently of any movement of the wedge element 28.

During its movement in the direction of the arrows G–H, the wedge element 28 is also guided by a roller 34 opposing the roller 31, said roller 34 being mounted freely rotatable in the support 26.

It should be noted that the entire support 26 together with the wedge element 28 and with the lever 22 carrying the roller 31, and together with the roller 34, can be caused to approach the die holder 11 to a greater or lesser extent, the position of this assembly relative to the press frame, indicated by the reference numeral 52, being adjustable by means of the adjustment screw 53. As will be explained hereinafter, this adjustment enables tubular rivets to be produced having a length which is variable within certain limits.

The wedge element 28 is moved by the following mechanism: a double arm lever 35–36 which reciprocates about a pin 37, the arm 35 of this lever acting against the end of the element 28 which is kept in contact with the arm 35 by a spring 38; a tie rod of adjustable length, indicated overall by 39, is hinged to the arm 36, and its other end is hinged to the end of a lever 40 which reciprocates about a pin 41; a cam 42 fixed on a control shaft 43 of the press and acting on a roller 44 supported in an intermediate position by the lever 40, said roller 44 being kept in contact with the cam 42 by a spring 45 acting on the lever 40.

The tie rod 39 comprises two threaded pins 46–47, one of which has a lefthanded thread and the other a righthanded thread, and a threaded sleeve 48 which connects together the two threaded pins 46–47, two nuts 49–50 being screwed on to the pins 46–47 to lock the sleeve 48 in the required adjusted position.

The contour of the cam 42, which with the shaft 43 rotates in the direction of the arrow V, has a lower level zone indicated by **42*a*, a first rising portion 42*b*, an intermediate level zone 42*c*, a second rising portion 42*d*, an upper level zone 42*e*, and a portion 42*f*** which descends towards the lower level zone (smallest radius from the centre of rotation).

It is apparent that during the rotation of the shaft 43, while the roller 44 rests on one of the zones **42*a*, 42*c* and 42*e* of constant level, the wedge 28 is not moved, so that the pin 16 and its head 17 assume predetermined position. When the roller 44 is on a rising portion 42*b* or 42*d* of the cam contour 42, the wedge 28 is moved in the direction of the arrow G, and consequently the pin 16 is moved in the direction of the arrow E. In contrast, when the roller 44 is on the descending portion 42*f* of the cam contour 42, the lever 40, the lever 35–36, the wedge element 28 and the lever 22 follow the movement under the action of the springs 45, 38 and 32. The pin 16 can also follow the movement by moving in the direction of the arrow F under the action of the spring 24, unless the member 33** acts on it.

The movement of the wedge element 28 in the direction of the arrows G and H is therefore strictly related to the contour of the cam 42. In constrast, the movement stroke of the pin 16 in the direction of the arrow E induced by the first rising portion **42*b* of the cam 42 can be varied within certain limits by varying the length of the tie rod 39 and consequently varying the starting position of the wedge element 28** relative to the roller 31 (when the roller 44 is on the lower level zone 42*a* of the cam contour 42). In this respect, if—as illustrated in FIG. 1—when in its starting position, the roller 31 is tangential to the angle formed by the inclined surface 29 and the flat part 30 of the wedge element 28, when this begins to move in the direction of the arrow G it immediately also causes an angular movement of the lever 22 to take place, and consequently a movement of the pin 16 in the direction of the arrow E. The entire movement stroke of the wedge element 28 induced by the rising portion 42*b* is utilised for moving the pin 16, and the movement stroke of this latter is a maximum. To obtain this condition, the position of the assembly formed by the support 26 and its supported members relative to the die holder 11 is adjusted by the adjustment screw 53 in such a manner as to obtain the maximum distance required for the longest rivets to be produced. Under such conditions, the head 17 of the pin 16 initially assumes its maximum withdrawn position in the bore 15 of the die 10.

If it is required to produce shorter rivets without changing the cam 42, the following procedure must be carried out. The support 26 is firstly moved towards the die holder 11 by adjusting the screw 53, such that the head 17 of the pin 16 assumes a more advanced starting position in the bore 15 of the die 10. Secondly, the first movement stroke of the pin 16 in the direction of the arrow E must be correspondingly reduced. As the movement stroke of the wedge element 28 in the direction of the arrow G as induced by the rising portion 42*b* of the contour of the cam 42 is fixed, it is necessary to make an adjustment such that part of the movement stroke of the wedge element 28 does not cause any movement of the pin 16. This is attained by turning the sleeve 48 in such a manner as to cause the threaded pins 46 and 47 to approach each other, and thus shorten the tie rod 39. In this manner, the wedge element 28 can move in the direction of the arrow H, such that the roller 31 when in its starting position comes into contact with the flat part 30 at a point farthest from the angle formed between the flat part and the inclined plane 29. It is therefore apparent that as the wedge element 28 moves in the direction of the arrow G under the thrust of the first rising portion 42*b* of the profile of the cam 42, it initially causes no movement of the roller 31 or correspondingly of the pin 16, as the flat part 30 is parallel to the direction of movement of the element 28, and only when the roller 31 comes into contact with the inclined plane 29 is it moved such as to also cause movement of the pin 16. The movement stroke of the pin 16 is therefore reduced for equal movment strokes of the wedge element 28.

However, it should be noted that the second movement stroke of the pin 16 in the direction of the arrow E never changes, because the inclined surface 29 of the wedge element 28 is always active in this respect.

Returning to the punches 13 and 14, it can be seen that the preparation punch 13 is solid, and comprises in its front centre a cavity 54 having the shape of the crude rivet head which is to be obtained on termination of the first press blow. The finishing punch 14 comprises in its front centre a cavity 55 having the final head shape of the rivet to be produced. By way of a passage bore 56 having a diameter substantially equal to or slightly greater than the diameter of the head 17 of the pin 16, said cavity 55 communicates with an inner chamber 57 of the punch 14, which itself, by way of a suitable passage, can be either connected to the outside or connected by means of a tube 58 to a suction source, not shown.

The method of operation of the described press for producing tubular rivets is described hereinafter with reference to FIGS. 2 to 7.

A mobile knife 63 cuts a piece 62 from a metal wire 60 originating from a skein (not shown) and passing through a cutting bush 61 (see FIG. 2), it then in known manner moving the wire piece 62 in an aligned position in front of the bore in the die 10.

The punch holder 12 is in the position in which the preparation punch 30 is aligned with the die 10, and the first blow now begins with the approach of the punch 13 to the die in the direction of the arrow C.

When the front cavity 54 of the punch 13 encounters the wire piece 62, it inserts it into the bore 15 of the die 10 until said wire piece comes into contact with the head 17 of the pin 16 (see FIG. 3), which in that moment is at rest in the initial position (determined by the wedge element 28 and the roller 44 on the lower level zone 42*a* of the contour of the cam 42).

The resistance offered by the pin 16–17 means that as the preparation punch 13 further advances, that part of the wire piece 62 which has not yet penetrated into the bore 15 of the die deforms to form a crude head 64 in the punch cavity 54. When this crude head is almost terminated, the pin 16 is made to advance (by the first rising portion 42*b* of the contour of the cam 42) from its first initial position to a second more advanced position (FIG. 4), so causing the material of the wire piece 62 to extrude about the pin head 17 in the die until a bore of the required depth is obtained in the shank of the rivet under production. The depth of this bore, which does not reach the crude head 64 of the rivet, depends on the advancement stroke of the pin 16.

At the end of its advancement stroke, the praparation punch 13 reaches a short distance from the fixed die but without touching it.

The preparation punch 13 is then withdrawn, and the pin 16 with the preformed rivet mounted over its head 17 remains in its second position (roller 44 on the intermediate level zone 42*c* of the contour of the cam 42).

The first blow thus terminates.

The punch holder 12 is now moved in order to bring the finishing punch 14 in alignment with the die, and the second blow begins by advancing the punch 14 in the direction of the arrow C.

As it advances, the finishing punch 14 encounters the crude head 64 of the preformed rivet, which then enters its front cavity 55, this latter then producing the final deformation of the rivet head. Simultaneously, the pin 16 is advanced from its second position to a third position (roller 44 on the rising portion 42*d* of the contour of the cam 42) in order to further extend the axial bore in the rivet until it passes its head, to shear a central bridge piece 65 (see FIG. 5) and then expel it through the passage 56 into the chamber 57 of the finishing punch 14. The expelled bridge piece can be removed from the chamber 57 through the suction tube 58. The tubular rivet 66 is thus produced.

The finishing punch 14 now withdraws in the direction of the arrow D, and the second blow terminates.

While the roller 44 then travels along the descending portion 42*f* of the contour of the cam 42 so enabling the wedge element 28 to return to its initial position, the pin 16 is further advanced by the member 33 until its head 17 emerges from the die (FIG. 6), where a grip 67 then retains the finished rivet while the pin 16 again withdraws (FIG. 7) into its initial position, all in known manner.

As is apparent from the description given heretofore, according to the invention it is possible to produce tubular rivets of length variable between certain limits, on a cold press with a fixed die and only two punches which do not comprise auxiliary moving parts, thus providing maximum safety and reliability, and permitting very high productivity.

Only simple adjustments are necessary for producing rivets of different length, and no parts need to be replaced. By replacing the cam 42 with another of different contour, the range of producible rivet lengths can be varied.

Other suitable means such as pneumatic or hydraulic cylinders can be used instead of a cam for inducing the movements of the wedge element 28, provided these are able to induce movements synchronised with the movements of the punches.

I claim:

1. A method for producing tubular rivets on a double blow press with a fixed die having a bore, a preparation punch, a finishing punch having a frontal cavity and a bridge piece cavity connected by a bore and a bore-forming pin, comprising the following operations:

(a) in a first working stage (first blow)

moving the preparation punch with a cavity therein towards the die bore until a residual distance remains to force a portion of a wire piece into the die bore and into contact with the bore-forming pin positioned in the die bore in a first position, deforming that part of the wire which has not penetrated into the die bore in order to form a crude rivet head by means of a frontal cavity in the preparation punch, moving said pin from said first position to a second more advanced position in the die bore in order to extrude the wire material about the end of the pin inside the die in order to produce a partial bore in the wire material of the required depth;

(b) in a second working stage (second blow)

moving the finished punch into contact with the crude rivet head to force the crude rivet head into the frontal cavity and produce final deformation of the rivet head, simultaneously moving said pin from said second to a third more advanced position in order to further extend the bore in the rivet shank until it passes beyond its head, to shear a material bridge piece and finally expel the bridge piece into a cavity in the finishing punch.

2. A double blow cold press for producing tubular rivets comprising a die holder, a die having a bore mounted in said die holder, preparation punch and a finishing punch alternatively alignable with the die bore on one side of said die, a bore forming pin having an end movable in said bore and an end outside of said bore opposite said punches, means to move the preparation punch with a cavity therein towards the die bore until a residual distance remains to force a portion of a wire piece into the die bore and into contact with said pin to form a crude rivet head on the part of the wire projecting from the die, means to move said pin from a first position in contact with said wire in said bore to a second position to cause the material of the wire piece to extrude about the pin in the die until a bore of a predetermined depth is obtained for the wire within said bore, and means for moving the finishing punch towards the die and into contact with the previously formed crude rivet head to finally deform the head, said means for moving said pin from a first position to a second position also move said pin simultaneously with the movement of said finishing punch from said second position to a third more advanced position in which an end of the pin facing the finishing punch emerges from the die and axially traverses the rivet head.

3. The press as claimed in claim 2, wherein the means for moving said pin from a first position to a third position includes a wedge element having an at least partly inclined container movable in a direction perpendicular to the pin axis, the end of said pin outside of said die bore being in contact with said contour.

4. The press as in claim 3, including a support for said wedge element, a press frame, said support being movable within said press frame, and means for adjusting the initial rest position of the wedge element relative to the end of the pin outside of the die bore.

5. A press as claimed in claim 4, wherein the wedge element contour comprises a first portion parallel to the direction of movement of said element, followed by a second inclined portion.

6. The press as in claim 3, wherein said means for moving said pin from a first position to a third position includes a shaft and a three stepped cam mounted on said shaft synchronized with the means for moving said punches.

7. The press as claimed in claim 6, wherein said means for moving said pin from a first position to a third position includes a transmission mechanism, said cam acting on said wedge element through said transmission mechanism.

8. The press as claimed in claim 7, wherein said transmission element comprises adjustment means for the position of the wedge element relative to the cam contour.

9. The press as claimed in claim 8, wherein said adjustment means are constituted by a variable length tie rod which connects a lever in contact with the wedge element to a lever in contact with the cam contour.

10. The press as in claim 2, wherein said finishing punch has a frontal cavity for forming the rivet head, an internal chamber in communication with said frontal cavity and a suction tube connected to said internal chamber for removing material residues arising as the rivet bore is extended through its head.

* * * * *